US005702644A

United States Patent [19]

Hlivka et al.

[11] Patent Number: 5,702,644

[45] Date of Patent: Dec. 30, 1997

[54] PITCH CONTROL COMPOSITION

[75] Inventors: Linda M. Hlivka, Flemington; George K. Wai, Mountain Lakes, both of N.J.

[73] Assignee: Ashland Inc., Columbus, Ohio

[21] Appl. No.: 584,967

[22] Filed: Jan. 11, 1996

[51] Int. Cl.[6] ..... B01F 17/18; B01F 17/52; C02F 5/12

[52] U.S. Cl. ..... 252/356; 162/DIG. 4; 252/180; 252/357

[58] Field of Search ..... 252/356, 357, 252/180; 162/DIG. 4; 536/52

[56] References Cited

U.S. PATENT DOCUMENTS

| | | | |
|---|---|---|---|
| 3,748,220 | 7/1973 | Gard | 162/DIG. 4 |
| 3,873,417 | 3/1975 | Otrhalek et al. | 162/DIG. 4 |
| 4,184,912 | 1/1980 | Payton | 162/DIG. 4 |
| 4,758,282 | 7/1988 | Stober et al. | 536/52 X |
| 4,964,955 | 10/1990 | Lamar et al. | 162/DIG. 4 |
| 5,246,548 | 9/1993 | Aston et al. | 162/DIG. 4 |
| 5,286,347 | 2/1994 | Richardson | 162/169 |
| 5,292,403 | 3/1994 | Dresibach | 162/158 |
| 5,387,675 | 2/1995 | Yeh | 536/52 X |

*Primary Examiner*—Richard D. Lovering
*Attorney, Agent, or Firm*—David L. Hedden

[57] ABSTRACT

This invention relates to a liquid composition for the control of pitch deposition in acid pulp and paper making operations comprising a derivatized cationic guar and an alkali metal polyacrylate dispersant. The invention also relates to a process for inhibiting pitch deposition on paper making equipment.

4 Claims, No Drawings

PITCH CONTROL COMPOSITION

TECHNICAL FIELD OF THE INVENTION

This invention relates to a liquid composition for the control of pitch deposition in acid pulp and paper making operations comprising a derivatized cationic guar and an alkali metal polyacrylate dispersant. The invention also relates to a process for inhibiting pitch deposition on paper making equipment.

BACKGROUND OF THE INVENTION

In a broad sense, "pitch" is any "sticky" substance found in the papermaking process. Sticky substances create problems in the paper making process when they deposit on paper making equipment. More specifically "pitch" refers to any soluble organic matter originating from the extracts of wood including fatty acids and esters, resin acids, and sterols. Pitch may also include process additives such as defoamers, sizing agents, and coatings, as well as inorganic components like calcium carbonate, silica, clay, magnesium and titanium. Pitch is released from wood during chemical and mechanical pulping.

Fine particles of pitch that remain well-dispersed do not create a deposition problem. However, there is a tendency for the hydrophobic pitch particles to agglomerate at the air-water interface. These pitch particles form deposits due to their decreased solubility as they move downstream (through cooler temperatures and varying pHs) and from the increased turbulence of the process. These pitch particles aggregate to form tacky threads or balls which then deposit on paper making equipment including chest walls, screens, paper machine headbox, wires, felts and dryers. This can also lead to sheet holes and breaks in paper resulting in increased downtime and/or lower quality paper.

Pitch deposition can be also be a problem in recycled or secondary fiber processes where organo-soluble pitch contaminants called "stickles", such as hot melts, polyethylene films, latexes, pressure sensitive adhesives, and waxes agglomerate and form deposits. These pitch contaminants deposit on equipment which similarly causes processing difficulties and decreases the quality of the final sheet.

Pitch control agents typically used am nonionic surfactants, especially nonyl phenol ethoxylates, talc and alum. Nonionic surfactants, which contain both a hydrophobic and hydrophilic segment, decrease the surface tension, provide wetting, detergency and dispersancy. However, nonyl phenol ethoxylates have a high foaming tendency which may result in higher defoamer usage, thus depositing more pitch. Talc is also used to control pitch deposition by adsorbing colloidal pitch onto the talc particles so it is retained in the sheet. The disadvantage of using talc is that it tends to deposit further downstream especially in paper machine felts and cause felt plugging. In acid paper making systems, alum or aluminum sulfate is used to decrease the tackiness of the pitch by cationic fixation to pulp. When using alum, pH control is critical to prevent deposition of alum as insoluble aluminum hydroxide.

Inorganic dispersants, like sodium polyacrylate and similar-type compounds, sequester or chelate the inorganic portion of the pitch particle but leave the organic segment free to redeposit. Surfactant/dispersant blends generally do not work well either on a papermachine due to pro-foaming tendencies. New approaches to pitch control via detackification mechanisms have recently been developed in the industry.

In the traditional acid sulfite cook, sulfurous acid and calcium sulfite accomplish dissolution of the lignin, hemicellulose and extractives in an acidic pH of 1.5. In industry, modifications have been made to use sodium, magnesium or ammonium as the cationic base instead of calcium (sulfite) to pulp a wider variety of wood species. Regardless of the cationic base used in sulfite pulping, the pulping pH can range from 1.5–4.0. Considerable quantities of organic acids are formed during the cooking process and acid buffering is essential to prevent deposition of the organic acids as pitch. The fatty acids and resin acids in the wood species are soluble up to pH=4.0. Moreover, up to 50% of these extractives remain dispersed in the cooking liquor and move along with the pulp as it makes its way downstream through the system. As the pH climbs above 4.0, tackiness increases and a greater tendency for pitch deposition results. There is also a potential for increased pitch deposition in the washing stages as water temperature decreases and resin and fatty acids are reprecipitated as pitch. Similarly, deposition problems occur during the bleaching process as pulp is chlorinated and the dispersed resin acids become tacky and more hydrophobic. In all cases, increased deposition can lead to sheet holes and breaks resulting in increased downtime or low quality paper production.

In Kraft pulping, sodium hydroxide is the major pulping chemical constituent. Although the mechanisms of delignification differ from the sulfite process, the end result is the same: to produce a high yield, high strength pulp. The pulping pH in a Kraft cook approaches 14 and trends downward in the subsequent stages as the pulp is processed. The pH can end up as low as 4–5 on a typical acid papermachine. Pitch deposition increases dramatically as pH is reduced from 10 to 4.

SUMMARY OF THE INVENTION

This invention relates to a liquid composition for the control of pitch deposition in acid pulp and papermaking operations comprising:

(1) a derivatized cationic guar; and (2) an alkali metal polyacrylate dispersant.

The composition can be used for hardwood and softwood pulp and papermaking processes.

Pitch deposition is effectively reduced in sulfite processes as well as in Kraft processes where pH is 1.5–6.0. Not only is pitch deposition controlled by using the subject compositions, but the ionic balance of the papermaking system is not disturbed. Thus detrimental interactions with other process additives are also limited. Additionally, the liquid composition does not generate additional foam which creates stress on the system.

ENABLING DISCLOSURE AND BEST MODE

The derivatized cationic guar used in the pitch inhibiting composition is a powder. Guar gum is a nonionic galactomannan ($m_w$=250,000 to 2 million) as obtained from the endosperm of the seed of the guar plant. To derivatize the guar, the nonionic guar is reacted with hydroxy propyl trimonium chloride to a certain degree of substitution which establishes the amount of cationic charge or charge density value in meq/g according to a proprietary process. Preferred derivatized cationic guars have a charge density of 0.01 meq/g to 3.0 meq/g, preferably 0.01 meq/g to 0.15 meq/g. Particularly preferred as the derivatized cationic guar are hydroxypropyl trimonium chloride, commercially available as N-Hance 3000, Galactasol 8OH2C, Jaquar 8914, Jacquar 8913 and 8917, among others. An aqueous solution of the derivatized cationic guar is made by slowly dissolving the guar in water, supplying heat and vigorous agitation.

The alkali metal polyacrylate has an average molecular weight of from 10,000 to 50,000, preferably 25,000 to 35,000, and $m_w/m_n$ (polydispersity number)=1.0–3.0, preferably 1.3–3.0, where $m_w$ is the average molecular weight, $m_n$ is the number average molecular weight, and the polydispersity is the breadth of $m_w$ distribution. The smaller the polydispersity number, the narrower the molecular weight distribution. The alkali metal polyacrylate is preferably a sodium polymethacrylate, for instance the homopolymer known as Tamol 850. The polymethacrylate polymer can be synthesized using a general process of free radical addition with such materials as azo compounds or peroxides to initiate the polymerization. Moreover, the polymer can be produced commercially via solution or emulsion polymerization.

The amount of derivatized cationic guar in the composition is from 1–20% by weight based upon the weight of the stabilized aqueous solution, preferably 3.5%. The amount of alkali metal polyacrylate in the composition is from 1–20% by weight based upon the weight of the stabilized aqueous solution, preferably 15.0%. Preferably the weight ratio of derivatized cationic guar to alkali metal dispersant is from 6:1 to 1:6, preferably from 5:1 to 1:5, most preferably 4.2:1.0 to 1.4:2.0.

The pitch control composition may be stabilized with an acid, typically up to 0.5 percent by weight, preferably about 0.30 percent by weight (hydrochloric, sulfuric, phosphoric, acetic or nitric) for viscosity modification to impart flow characteristics, where said weight percent is based upon the weight of aqueous pitch control composition.

The invention also relates to a process for inhibiting pitch deposition on paper making equipment. The amount of pitch control composition needed to effectively reduce the amount of sticky substances in the paper pulp is from 0.1 ppm to 200 ppm based upon the weight of the dry fiber. The pitch control composition can be added to any feedpoint in the pulp and papermaking process, for instance the first, second, or third stage washers of the pulp mill, the deckers of the pulpmill, the screens, post bleaching operations, and the paper machine itself.

The pitch control composition reduces pitch deposition under pulping/papermaking sulfite conditions as well Kraft papermachine conditions in laboratory simulations at a dosage of 0.10 ppm to 100 ppm based on the weight of dry fiber, preferably at a dosage of 50 ppm, most preferably at a dosage of 15 ppm to 50 ppm.

The following abbreviations are used in the examples which follow:

ABBREVIATIONS

DCG=guar hydroxypropyl trimonium chloride having a charge density=0.03 meq/g)

DETAC=pitch control agent sold by Betz as Detac 1156 containing 9% polyvinyl alcohol as the active ingredient MT=maleic terpolymer NPE=nonyl phenol ethoxylated with 9 moles of ethylene oxide.

SPAD=sodium polyacrylate homopolymer dispersant having an average molecular weight of about 2000

PPC=phosphinocarboxylate

PPCC=phosphinocarboxylate copolymer

PMA=polymaleic acid

SPMD=sodium polymethacrylate dispersant having an average molecular weight of 30,000

Preparation of Synthetic Pitch

A synthetic pitch mixture was utilized in the laboratory to simulate Kraft papermachine pitch. Deposition tests were then run to determine product efficacy. A 0.5% consistency pulp slurry was prepared in a stainless steel beaker using bleached hardwood pulp and heated to 50° C. Then, a tall oil fatty acid was introduced into the slurry with agitation, by a propeller-type mixer, followed by sodium carbonate and calcium chloride to create a colloidal pitch solution. The final pH of the solution was adjusted between 4.0–6.0. A preweighed stainless steel coupon was suspended in the slurry to be used as a pitch collector. Temperature and agitation were maintained for a period of 10–30 minutes. The mechanical shear on the slurry forced the pitch out of solution to deposit on the coupon as well as the sides and bottom of the beaker and along the shaft of the stainless steel agitator. After the mixing period, the coupon beaker and agitator were gently rinsed to remove fibers. The amount of deposition was determined by difference of the initial weights of the coupon, beaker and agitator subtracted from the oven-added final weights. The deposition reduction for treated samples was expressed as a percentage based on the total deposit weight recorded for a control (untreated) sample. The experimental data for this method is shown in Table 1. Examples A–F are comparison examples.

TABLE 1

EXPERIMENTS USING KRAFT MILL PITCH AT pH = 5.0)

| Example | Additive | Active Dosage | mg Deposition | % Pitch Reduction |
|---|---|---|---|---|
| Control | None | 0 | 108.1 | — |
| A | NPE | 50 | 60.4 | 44.1 |
| B | NPE/SPAD | 50 | 84.8 | 21.5 |
| C | SPAD | 50 | 44.1 | 59.2 |
| D | DCG | 50 | 45.4 | 58.0 |
| E | SPMD | 50 | 24.1 | 77.7 |
| F | DETAC | 50 | 16.9 | 84.3 |
| 1 | DCG/SPMD | 50 | 7.0 | 93.5 |

These experiments indicate that the control and the comparative examples, which are well-known pitch control compositions used in industry, nonionic surfactants, inorganic dispersants and surfactant/dispersant blends, did not perform as well as the pitch control composition of this invention (Example 1). In particular, DETAC inhibited only 84% of pitch and had over twice as much weight deposition (in milligrams) when compared to the DCG/SPMD composition. The DCG/SPMD shows superior performance at 93.5% pitch reduction. The data would indicate that a synergism between the DCG and SPM exists since much less effective performance (higher deposition rates) resulted when each was tested alone.

Additional testing was done to simulate sulfite mill conditions. A 1% consistency pulp slurry was prepared in a beaker using bleached pulp and heated to 45° C. Actual sulfite mill papermachine pitch (analyzed as 88% fatty acids) that had been uniformly redispersed in hexane and isopropanol was added to the pulp sample. The final pH of the slurry was adjusted to 4.5. A pitch control agent was then added. A preweighed 2"×3" stainless steel coupon was suspended in the slurry as a pitch collector. A preweighed propeller-type mixer was inserted into the beaker to provide agitation for 10 minutes and to serve as an additional pitch collector site. After mixing, the coupon, beaker and agitator were gently rinsed to remove fibers. The amount of deposition was determined by the difference of the initial weights of the coupon, beaker and agitator subtracted from the final oven-added weights. The deposition reduction for treated samples was expressed as a percentage of the total deposit weight recorded for a control (untreated) sample. The results are shown in Table II. Examples G–P are comparison examples.

TABLE II

SULFITE PITCH AT A pH = 4.5

| Example | Additive | Active Dosage | mg Deposition | % Pitch Reduction |
|---|---|---|---|---|
| Control | none | 0 | 106.3 | — |
| G | SPAD | 50 | 61.0 | 42.6 |
| H | NPE | 50 | 37.92 | 64.3 |
| I | NPE/ SPAD | 50 | 37.0 | 65.1 |
| J | DCG | 50 | 106.3 | 0 |
| K | DCG/MT | 50 | 76.2 | 28.3 |
| L | DCG/PCC | 50 | 59.1 | 44.4 |
| M | DCG/PCC | 50 | 96.9 | 8.8 |
| N | DCG/ PMA | 50 | 69.5 | 34.4 |
| O | SPMD | 50 | 48.9 | 53.9 |
| 2 | DCG/ SPMD | 50 | 11.7 | 89.0 |
| P | DETAC | 50 | 25.5 | 76.0 |

As can be seen from the data in Table II, a similar trend appeared for sulfite pitch that occurred with Kraft mill pitch. The DCG/SPM blend again outperformed the other treatments including DETAC. Similarly, neither the DCG or SPM alone significantly affected pitch deposition reduction. Only when they are blended together is improved efficacy seen.

Table II also shows the effect of replacing the SPM with other inorganic dispersants. None of the replacements performed as well as the SPMD used in the in the blended product containing DCG. Therefore, it is apparent the synergism is unique to the blend, resulting in vastly reduced pitch agglomeration and deposition in acid papermaking systems.

We claim:

1. A liquid composition for the control of pitch deposition in acid pulp and paper making comprising in aqueous solution:

(a) a derivatized cationic guar having a hydroxypropyl trimonium group wherein the charge density of the derivatized cationic guar is from 0.01 meq/g to 3.0 meq/g.; and (b) an alkali metal polyacrylate dispersant wherein the average molecular weight of the sodium polymethacrylate dispersant is from 10,000 to 50,000, where the amount of derivatized cationic guar in the composition is from 1–20% by weight based upon the weight of the stabilized aqueous solution and the amount of alkali metal polyacrylate in the composition is from 1–20% by weight based upon the weight of the stabilized aqueous solution.

2. The pitch control composition of claim 1 wherein the alkali metal polyacrylate dispersant is sodium polymethacryate.

3. The pitch control composition of claim 2 wherein the average molecular weight of the sodium polymethacrylate dispersant is from 10,000 to 30,000.

4. The pitch control composition of claim 3 wherein the polydispersity ($m_w/m_n$) is from 1.3 to 3.0.

* * * * *